US006215059B1

(12) United States Patent
Rauchi et al.

(10) Patent No.: US 6,215,059 B1
(45) Date of Patent: Apr. 10, 2001

(54) METHOD AND APPARATUS FOR CREATING MUSICAL ACCOMPANIMENTS BY COMBINING MUSICAL DATA SELECTED FROM PATTERNS OF DIFFERENT STYLES

(75) Inventors: Francesco Rauchi, San Benedetto del Tronto; Luigi Bruti, Pedaso; Demetrio Cuccu', Fermo; Luigi Ferrari, Porto d'Ascoli, all of (IT)

(73) Assignee: Roland Europe S.p.A., Acquaviva Picena (IT)

( * ) Notice: Subject to any disclaimer, the term of this patent is extended or adjusted under 35 U.S.C. 154(b) by 0 days.

(21) Appl. No.: 09/449,930

(22) Filed: Nov. 24, 1999

(30) Foreign Application Priority Data

Feb. 23, 1999 (IT) ..... MI99A0361

(51) Int. Cl.[7] ..... G10H 1/40
(52) U.S. Cl. ..... 84/611; 84/635; 84/DIG. 12
(58) Field of Search ..... 84/611, 612, 635, 84/636, 651, 652, 667, 668, DIG. 12

(56) References Cited

U.S. PATENT DOCUMENTS 4,685,370 8/1987 Okuda et al. .
5,457,282 10/1995 Miyamoto et al. .
5,663,517 * 9/1997 Oppenheim ..... 84/651 X
5,679,913 10/1997 Bruti et al. .
5,756,917 * 5/1998 Watanabe et al. ..... 84/635 X
5,920,025 * 7/1999 Itoh et al. ..... 84/611

* cited by examiner

*Primary Examiner*—Stanley J. Witkowski
(74) *Attorney, Agent, or Firm*—Young & Thomson

(57) ABSTRACT

A morphing method and an apparatus for creating musical accompaniments from a combination of musical data selected from stored patterns or tables belonging to accompaniments of different musical styles. Musical data relating to a pattern of a first style and musical data relating to a second style, as well as the desired combination of morphing degree are selected from a plurality of stored data patterns. The musical morphing of the new arrangement is created by conjointly reading in real time one or more data tracks of two or more selected patterns, relating to different families of musical instruments, and combining the read tracks in a new virtual pattern that can be stored and/or played in a musically significant manner, by making the musical measures and the temporal lengths of the tracks of the new pattern, conform with the musical measures and temporal lengths of the tracks relating to one of the patterns selected or creating the new musical arrangement.

10 Claims, 6 Drawing Sheets

METHOD AND APPARATUS FOR CREATING MUSICAL ACCOMPANIMENTS BY COMBINING MUSICAL DATA SELECTED FROM PATTERNS OF DIFFERENT STYLES

BACKGROUND OF THE INVENTION

The invention relates to a method and an electronic apparatus for the creation of new arrangement of melodic and/or rhythmic parts of musical accompaniments from patterns of different styles and namely by transforming the musical morphology of at least a first style into a second style according to a pre-programmed scheme of data replacement and degree, in order to obtain one or more new intermediate styles by means of a musical procedure hereafter referred to as musical "style morphing". For the purpose of the present invention "musical morphing" means the construction of a new arrangement or pattern of an intermediate style, by an appropriate combination of musical data pertaining to different tracks of base patterns relating to two or more base arrangements of different styles, while the morphing degree depends from the number and/or type of tracks of the base patterns combined in the new pattern of new or intermediate style.

This invention represents an improvement of the electronic apparatus for the automatic composition and reproduction of musical data, of a previous patent U.S. Pat. No. 5,679,913, which is regarded as an incorporated part of the present description, although some useful parts thereof will be resumed to better describe the present invention.

PRIOR ART

As it has already been reported in the previous patent U.S. Pat. No. 5,679,913, in an electronic musical instrument which uses an automatic apparatus capable of recording and reproducing data, the various musical pieces, being either "patterns" or tables relating to accompaniments of different musical styles, are generally written in digital form and memorized on several tracks to be subsequently reproduced in such a way that a performer is able to control them in an interactive manner and in real time.

At present, "arrangers" or similar apparatuses capable of recording and reproducing accompaniments relating to various musical styles, which can be combined together during the execution thereof, make use of a data recording and reproducing method that is substantially based on multitrack system, in which the lengths of individual tracks must be identical to one another and must be a whole multiple of a "bar" or of a same musical measure; moreover, also the "time signature" must be identical for the tracks relating to the various instrument families of each data pattern to be recorded and/or reproduced.

Therefore, with the currently known apparatuses, it is not possible to create accompaniments of different styles by collecting data from tracks having different lengths and/or time signature because, otherwise, it would not be possible to obtain a musically consistent synchronization when reading the various tracks. Systems of this kind are described, for example, in U.S. Pat. No. 4,685,370.

From a subsequent patent U.S. Pat. No. 5,457,282, an automatic accompaniment apparatus is also known, by which a plurality of original accompaniment patterns, relating to various styles, may be used to compose new patterns or new arrangements by collecting together the desired pattern parts which may be combined to create a new accompaniment.

This patent U.S. Pat. No. 5,457,282 merely proposes a different system for composing accompaniment patterns, without providing the performer with any possibility of selecting musical pieces or parts thereof among the several groups of track relating to the available accompaniment patterns, or of modifying the "style" of a song and/or accompaniment in its rhythmic part in real time, while maintaining a synchronized and musically consistent performance.

The apparatus described in the previous patent U.S. Pat. No. 5,679,913 tackled this problem and the present invention stands for an improvement thereof. This patent proposes an electronic apparatus for the composition and reproduction of musical data codified in numerical form, by means of which the performer is able to freely compose and reproduce pre-stored musical patterns or patterns provided on purpose by the same performer, or by using accompaniment patterns of different styles, which can be selected, combined and reproduced in real time in a musically significant manner while being automatically performed.

The previous patent U.S. Pat. No. 5,679,913, to which the present invention is referred, describes only the technical means to carry out a style modification in a universal manner; practically the previous patent makes a transformation process possible between two styles, which are different and are not similar (for example, having different time signatures—3/4, 4/4—and different measures). In the previous patent, moreover, the possibility is described to exchange tracks between two styles without mentioning at all the consistence of the musical result, unless such operation is made by an expert musician ("collage").

OBJECTS OF THE INVENTION

The general object of the invention is to provide a method for creating new musical styles and, in particular, new arrangements of melodic and/or rhythmic pats of musical accompaniments on the basis of pre-stored base styles, and by going through one or more musical morphing steps, which make it possible to migrate from at least one style into another one in a musically consistent and significant manner, so as to obtain a remarkable higher number of automatic accompaniments than the pre-stored ones, while keeping a same original memory size of an electronic musical apparatus. This way, new intermediate arrangements can be created between two styles, by gradually and selectively moving, through subsequent morphing steps, from a musical arrangement of a first base style into an arrangement of a second base style.

Another object of the invention is to provide a method as described above, by which it is possible to automatically change the morphing degree during the transition from a first current style into a second style, according to a predetermined substitution or combination scheme for the musical data that can be changed by a performer each time.

Another object of the invention is to provide a method for creating arrangements of new musical styles, by suitably combining musical data of two or more musical patterns of different styles, to generate a new virtual pattern that can be stored and/or played in a musically consistent manner.

Yet another object of the invention is to provide an apparatus for creating musical arrangements by morphing musical accompaniments of different styles according to the method referred to above, such apparatus being an integral part of an electronic musical instrument.

BRIEF DESCRIPTION OF THE INVENTION

According to a first aspect of the invention, a method for creating arrangements of melodic and/or rhythmic parts of musical accompaniments has been provided, by musically morphing accompaniments of different base styles, in which each accompaniment comprises a musical pattern including a plurality of data tracks relating to different families of musical instruments, comprising the steps of:

storing a number of musical patterns of different base styles into a memory of an electronic apparatus suitable for the composition and playing of musical data, said apparatus comprising control means to select the musical patterns stored in said memory;

selecting a first musical pattern relating to a first base style among said plurality of musical patterns stored in said memory;

selecting a second musical pattern relating to a second base style among said plurality of stored musical patterns stored in said memory; and creating a new accompaniment of an intermediate style by a musical morphing procedure comprising the additional step of reading data tracks of one of said selected patterns, and replacing musical data of at least one track of one of said selected patterns, to musical data of a homologous track of the other one of said selected patterns, making the musical measure number and the temporal length of the track of the said one pattern conform with the musical measure number and temporal length of the track of the other one pattern, while keeping musically consistent conditions during the track replacement and the performance of the new musical accompaniment.

According to a further aspect of the invention, a method for creating arrangements of musical accompaniments between at least a first and a second musical pattern of different styles has been provided, in which each musical pattern comprises a set of tracks of musical data belonging to different types of instrumental accompaniments, and in which different musical morphing degrees can be selected by a user by successively replacing musically homologous tracks between a musical pattern relating to a first style and a musical pattern relating to a second style, and wherein different types and quantities of musical tracks belonging to the first and respectively to the second pattern, correspond to different morphing degrees.

According to another aspect of the invention, a method has been provided to create arrangements of musical accompaniments by musical morphing between a first and a second pattern, in which each musical pattern comprises a first track relating to a drum accompaniment (ADR), a second track relating to a bass accompaniment (ABS), and a set of tracks relating to different types of orchestral accompaniments (AC1–AC6), and in which different and progressively increasing musical morphing degrees can be chosen between the selected patterns, wherein:

a first morphing degree comprises the data track relating to the drum accompaniment of one of the patterns, in substitution of a corresponding data track of the other one of the patterns, and the remaining data tracks of the latter;

a second morphing degree comprises the data track relating to the bass accompaniment of one of the patterns, in substitution of a corresponding data track of the other one of the patterns, and the remaining data tracks of the latter;

a third morphing degree comprises at least part of the data tracks relating to the orchestral accompaniments of one of the patterns, in substitution of the corresponding data tracks of the other one of the patterns, and the remaining data tracks of the latter;

a fourth morphing degree comprises the data track relating to the drum accompaniment and the data track relating to the bass accompaniment of one of the patterns, in substitution of corresponding data tracks of the other one of the patterns, as well as the remaining data tracks of the latter;

a fifth morphing degree comprises the data track relating to the drum accompaniment and at least part of the data tracks relating to the orchestral accompaniments of one of the patterns, in substitution of the corresponding data tracks of the other one of the patterns, as well as the remaining data tracks of the latter;

a sixth morphing degree comprises the data track relating to the bass accompaniment and at least part of the data tracks relating to the orchestral accompaniments of one of the patterns, in substitution of the corresponding data tracks of the other one of the patterns, as well as the remaining data tracks of the latter.

According to a further aspect of the invention, an electronic apparatus has been provided suitable to create arrangements of musical accompaniments by morphing musical patterns from a plurality of patterns of different base styles, in which each musical pattern comprises a number of tracks having musical data belonging to different instruments families, in which the musical data of the tracks comprise musical measure numbers and temporal lengths, and in which different musical morphing degrees are provided by replacing musical data of at least one track of a first pattern, to musical data of a homologous track of a second pattern selected from said plurality of patterns of different styles, the apparatus comprising:

a programmable control unit;

memory means to store in said control unit a plurality of musical patterns relating to different accompaniment base-styles;

program means in the control unit comprising first program instructions to select first and second musical patterns selected from said plurality of patterns stored in said memory means, and to automatically relate said first and second musical patterns selected from said plurality, as well as second program instructions to define different musical morphing degrees between said first and second selected patterns of different styles;

first manually operable selecting means, to select patterns from said plurality of patterns of different styles;

second manually operable selecting means to select a musical morphing degree; and program control means in the control unit to conjointly read-out musical data of some tracks of one of said musical patterns, and respectively musical data of the tracks of the other one of said musical patterns corresponding to remaining homologous data tracks of said one pattern, in accordance with a selected morphing degree, thus making the musical measure number and the temporal length of the tracks of said other one pattern, conform with the musical measure number and the temporal length of the remaining tracks of said one pattern, while keeping musically consistent conditions during reading of the data tracks and the performance of the new musical accompaniment.

According to a further aspect of the invention, a method has been provided for creating arrangements of melodic and/or rhythmic parts of musical accompaniments by musically morphing between accompaniment of different styles, in which each accompaniment comprises a musical pattern including data tracks relating to different families of musical instruments, comprising the steps of:

storing a plurality of musical patterns of different styles into a memory of an electronic apparatus suitable for the composition of musical data;

conjointly reading out different data tracks from at least a first and a second patterns of the plurality of patterns stored in said memory; and creating a new accompaniment by performing a musical morphing procedure between said at least a first and a second patterns, comprising the additional step of replacing musical data of at least a track relating to one of said patterns, with musical data of a homologous track of the other one of said patterns, and making the musical measure number and the temporal length of the track of the said other one pattern, conform with the musical measure number and temporal length of the track of said one pattern, while keeping musically consistent conditions during track replacement and the performance of the new musical accompaniment.

BRIEF DESCRIPTION OF THE DRAWINGS

The electronic apparatus and method according to the invention will be described in greater detail herein below, with reference to the enclosed drawings, in which.

DETAILED DESCRIPTION OF THE INVENTION

Figure 1:
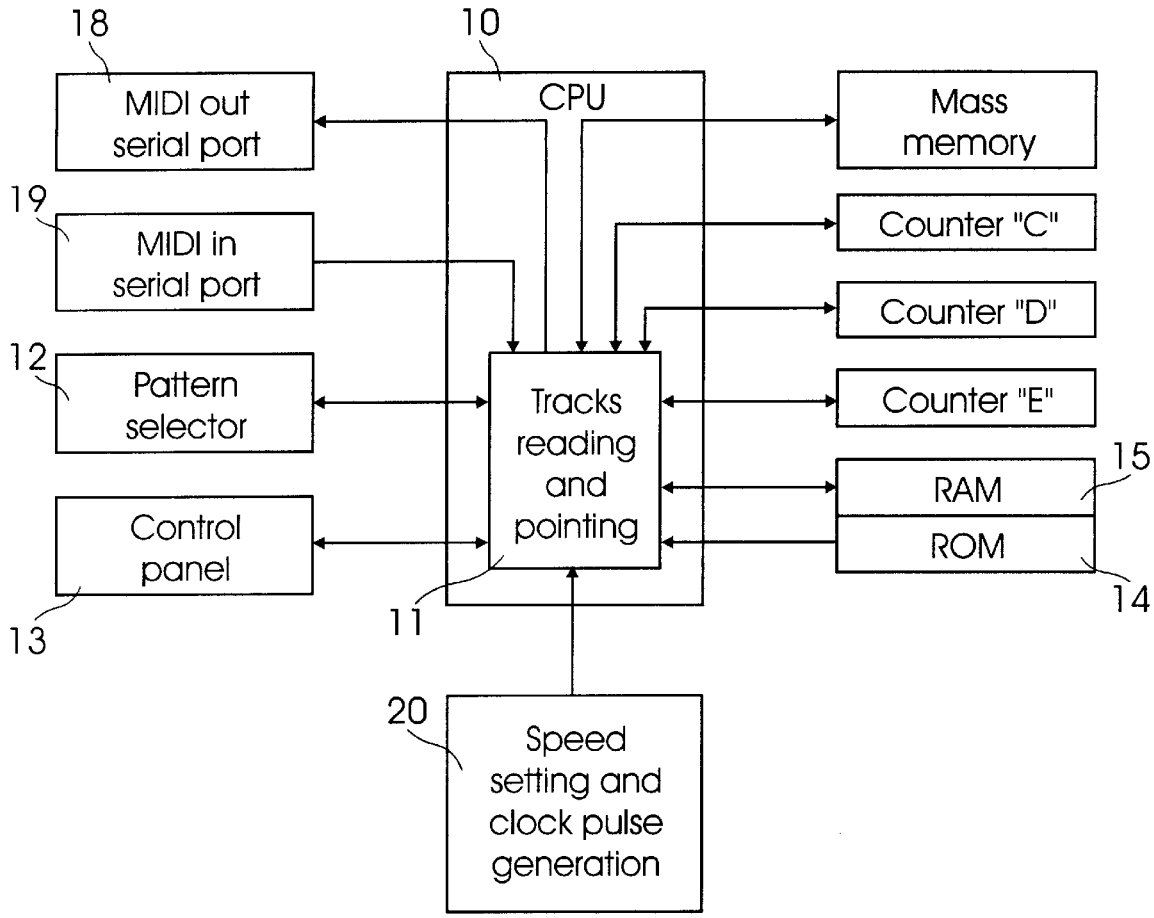
FIG. 1 is a block diagram relating to the apparatus for the creation of new musical arrangements by morphing accompaniments of different styles according to the invention.
Figure 2:
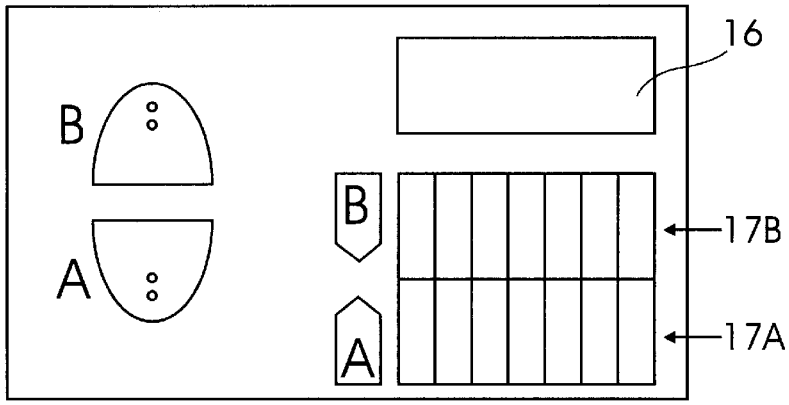
FIG. 2 shows in detail the control panel of the apparatus of FIG. 1.

The general features of the electronic apparatus for the creation of musical arrangements by morphing different base styles according to the invention, will be now described by making reference to the FIGS. 1 and 2.

As shown in FIG. 1, the apparatus comprises several functional blocks connected with a data processing and control unit 10, such as a CPU, which includes a block 11 comprising a reader having a number of pointers for reading out data tracks and information contained in the other functional blocks of the apparatus.

In addition to the block 11 for pointing and reading the data contained in the tracks of the several musical base patterns relating to the various musical styles that are already stored in a memory unit, the apparatus comprises a first ROM memory 14, namely a read-only memory, in which patterns of musical data for a plurality of accompaniments relating to different musical base styles have been stored, whereby such data can be either read directly by the ROM memory 14 or transferred into a RAM memory 15, a random access memory, for their composition.

The apparatus comprises also a pattern selecting block 12 including some buttons for selecting pre-stored patterns relating to the various musical styles, this block 12 being associated with a control panel 13, which is provided with the necessary switches to start the different functions and select the parameter values in a completely usual manner.

As shown in FIG. 2, the control panel 13 is also provided with two buttons, A and B, to assign the pre-stored patterns relating to the various accompaniment base styles; by means of these two buttons several functions can be activated like, for example, that assigning automatically two accompaniment styles (style A, style B) whose musical data can be exchanged by morphing the homologous tracks of the selected patterns, or that defining the morphing degree depending on the type and number of homologous tracks to be replaced when changing from one style into the other, or that allowing the performer to freely choose the styles whose musical data have to be morphed by transferring the homologous tracks of the patterns belonging to different styles that the performer could even freely program in the RAM memory 15, as it will be explained further on.

Beside the A and B buttons for the style assignment and the selection of the morphing degrees of musical patterns belonging to different styles, the control panel 13 includes also a display 16, on which indications about the selected base styles appear as well as some lit graphic representations showing the selected morphing degree, that comprise a number of lit bars, 17A and 17B, divided into two rows, one close to the other and each one in relation with the corresponding button, A or B; the lit graphic bar rows, 17A and 17B, are hence meant to visually indicate the various degrees of either transformation or approximation by musically morphing the style A into the style B, and vice versa, as it is schematically represented in the FIGS. 3 through 10 of the enclosed drawings and in the table shown further ahead.

The patterns of musical data relating to the several accompaniment base styles, that have been either pre-stored by the manufacturer in the ROM memory 14, or freely created by a performed in the RAM memory 15, can be read by an external device by means of a MIDI OUT serial port, referred to as 18, by sending adequate control signals or by means of a MIDI IN serial port, referred to as 19, which receives musical data coming from external control devices or sources, like for instance, a musical keyboard, a floppy disk and the like.

In addition, the apparatus comprises some counters, C, D and E, for counting the clock pulses emitted by a pulse generator inside the block 20, which are intended to perform various functions; more precisely it comprises a counter C, which counts the clock pulses used to determine the distance between two successive musical events in each track of a musical pattern; this counter, in practice, at the speed set by the clock signals, decreases the value of the number of the clock or CPT signals of the data patterns contained in the memories 14 and 15, read by the reading block 11, when the counting down reaches the value zero. Furthermore, the apparatus comprises a counter D for counting the clock pulses used to determine the distance of the musical event read first in a bar, from the start point of the next musical bar, as well as a third counter E for counting the clock pulses used to synchronize the readings of the various data patterns that are selected dynamically. All this matter is explained in greater detail, with specific reference, in the previously mentioned patent U.S. Pat. No. 5,679,913.

As previously mentioned, the ROM memory 14 contains a plurality of musical patterns in a separate area, whereby each of these patterns comprises a set of parallel tracks including the musical data relating to the various instrument families, which make up that particular musical accompaniment style.

Beside the memory means 14 and 15, the CPU 10 is also provided with program means including program instructions, that in a pre-defined manner, are capable of selecting and combining every musical pattern of one base style with the musical patterns of a different base style, such patterns being similar with one another and being chosen among a plurality of musical patterns by using appropriate selection means, namely either the buttons A or B on the control panel or any other adequate means.

Beside the instructions for selecting and combining patterns of styles that are different but musically similar, the programming means, including the ROM memory, contain program instructions for selecting the musical morphing degree, that results from subsequent replacements of one or more musically homologous tracks between data patterns relating to the style A, and data patterns relating to the style B.

A replacement of a different type and number of tracks in a manner that is either pre-determined by the manufacturer in the ROM memory or programmed by the end user in the RAM memory, corresponds with each morphing degree.

The above will be clarified in more detail herein below with reference to the remaining FIGS. 11 to 18 of the enclosed drawings, in which different musical morphing degrees have been depicted between two patterns A and B each having eight homologous tracks pertaining to different musical families.

According to a particular aspect of the invention it is possible to provide the program means with the instructions necessary to set different morphing degrees for each pair of selected patterns. For example, taking the following indications into consideration:

ADR stands for the track related to drums;

ABS stands for the track related to bass;

AC1–AC6 stand for the tracks relating to the various instrument families of orchestral accompaniments.

Considering also that the apparatus is capable of reading the ADR and ABS tracks individually and of reading all the tracks from AC1 through AC6 simultaneously or just some of them, the six different morphing degrees shown in the table below are made possible:

TABLE

Figure 3:
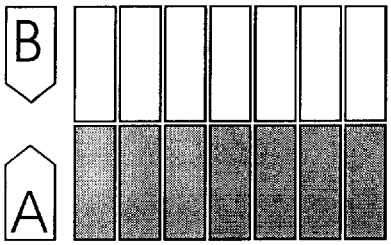
FIGS. 3 to 10 show the lit graphic representations of the panel as per FIG. 2 and represent the various possible morphing degrees between two different styles.
Figure 4:
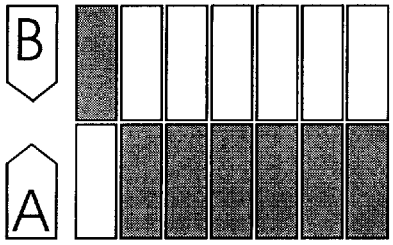
Figure 5:
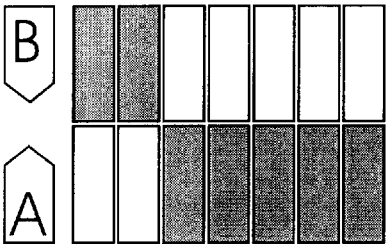
Figure 6:
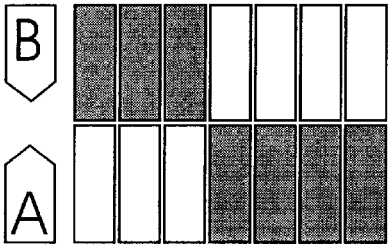
Figure 7:
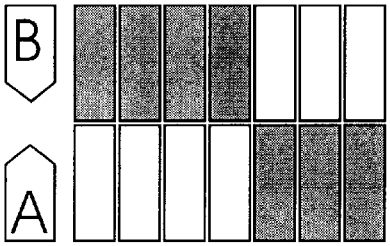
Figure 8:
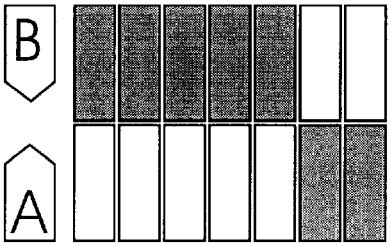
Figure 9:
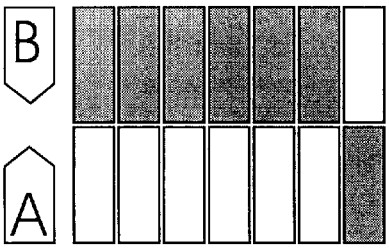
Figure 10:
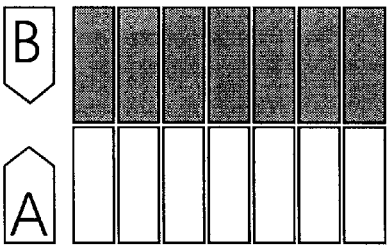
Figure 11:
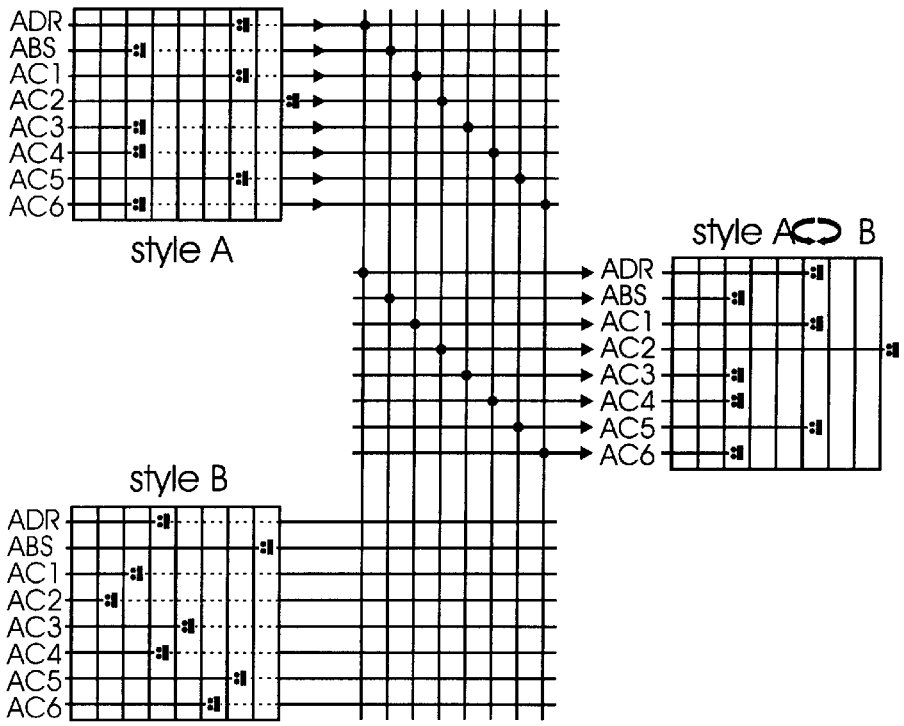
FIGS. 11 to 18 show the schematic representations of the various morphing degrees.
Figure 12:
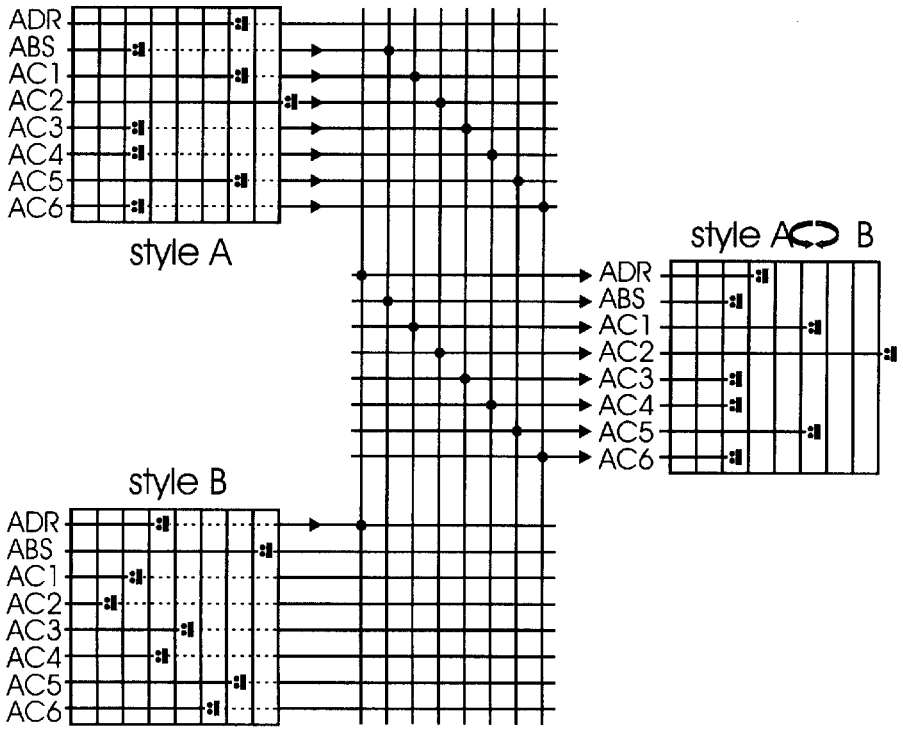
Figure 13:
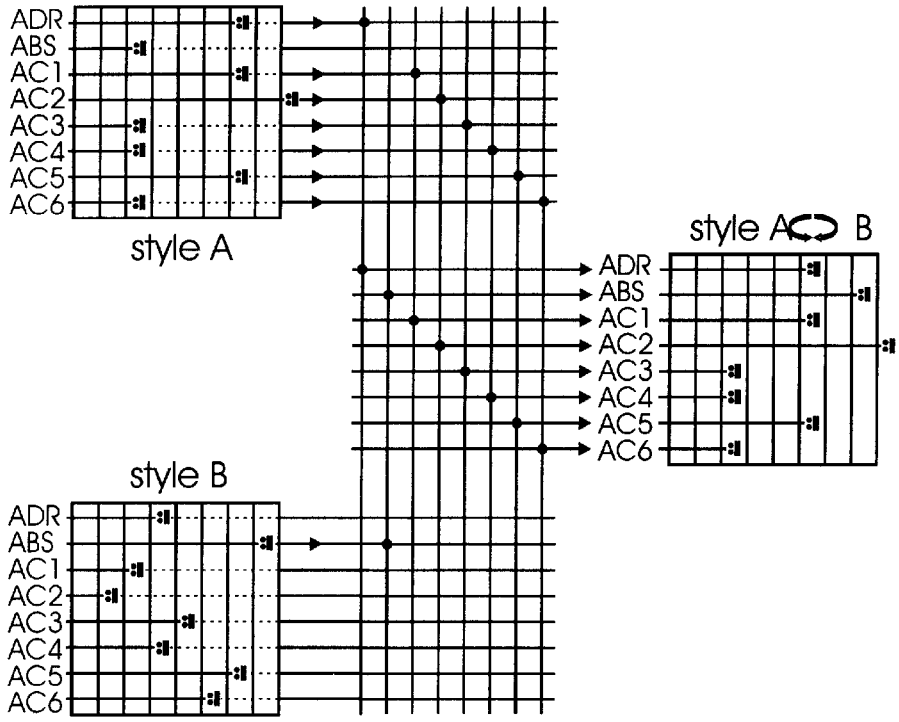
Figure 14:
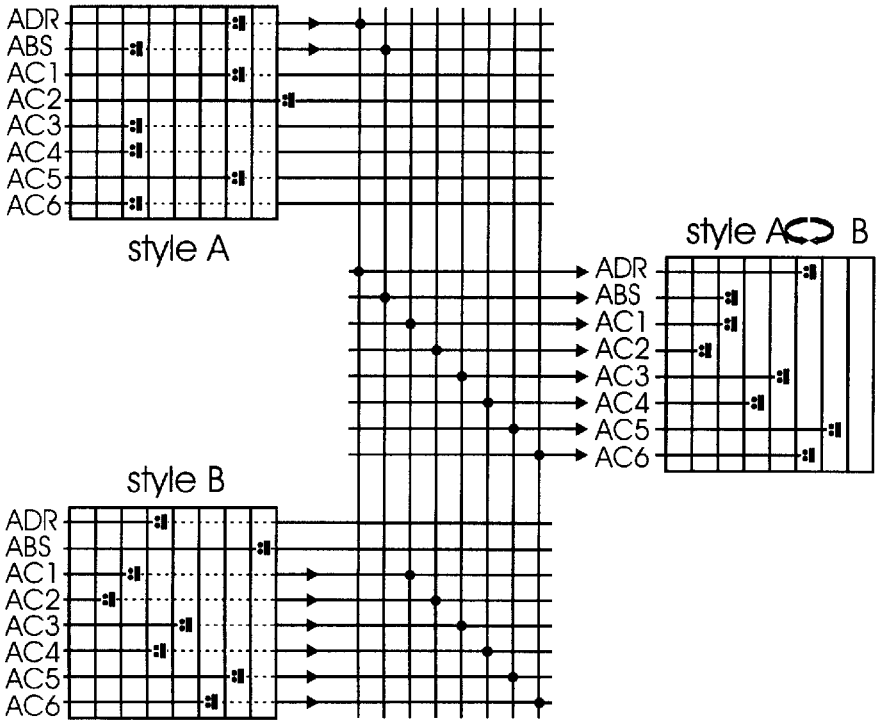
Figure 15:
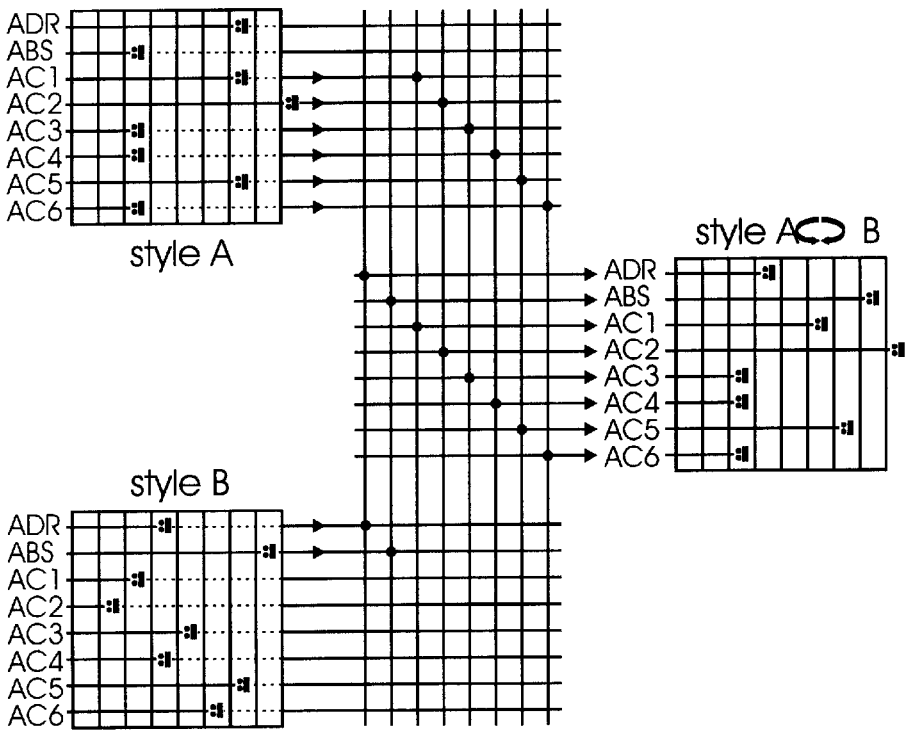
Figure 16:
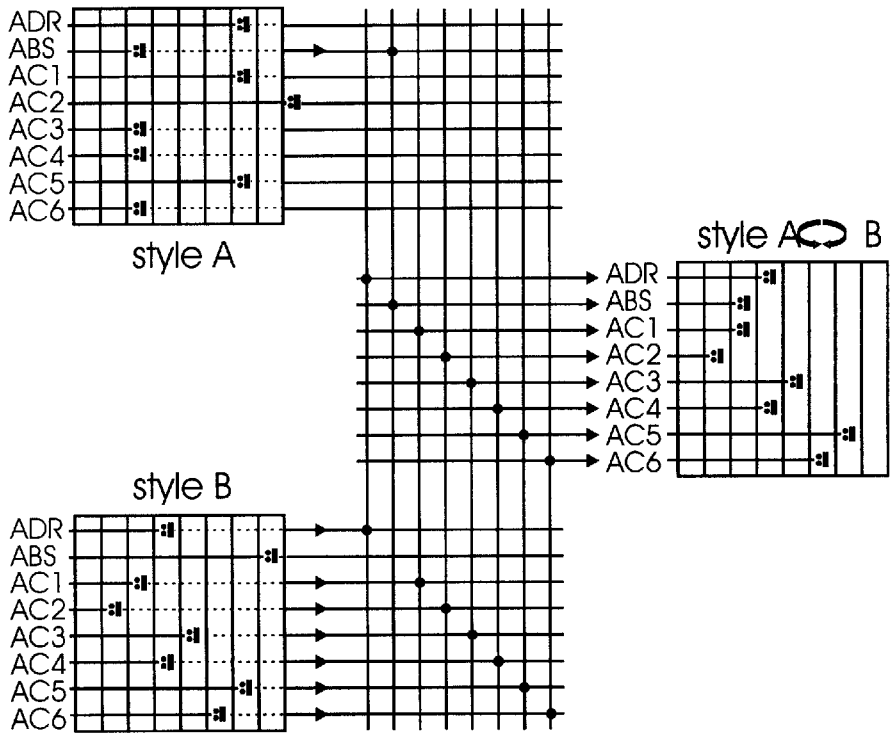
Figure 17:
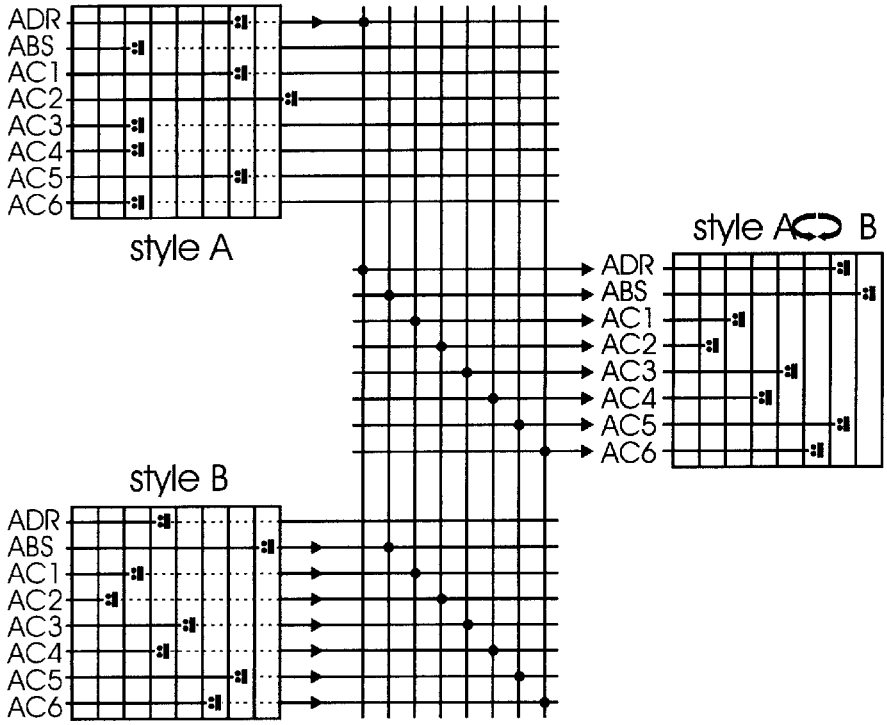
Figure 18:
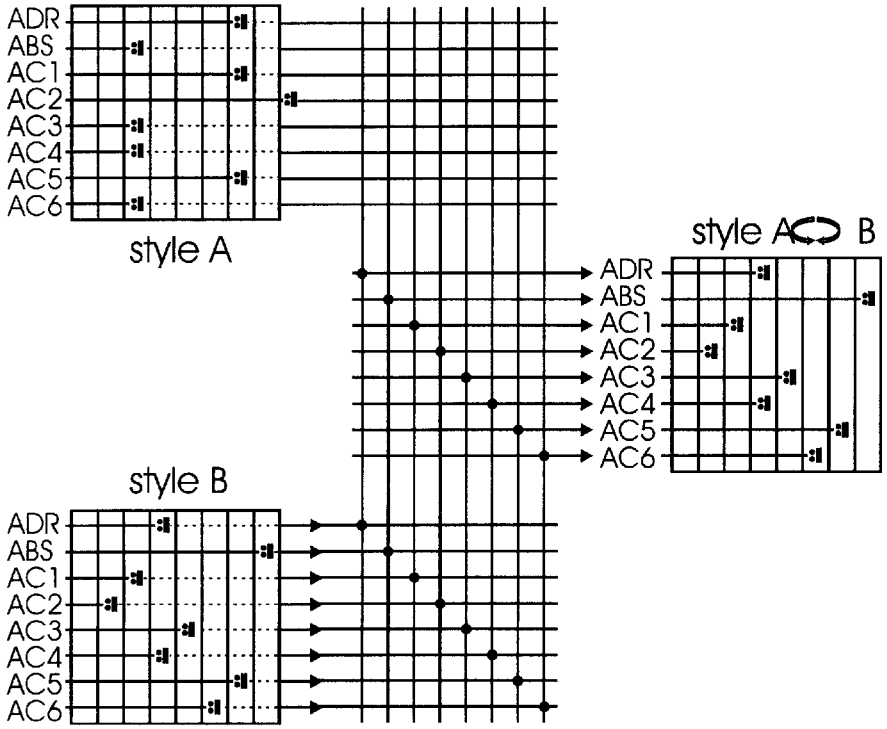

| Morphing Degree | Pattern A | Pattern B | lit graphic representation | Transformation degree |
|---|---|---|---|---|
| 0 | ADR-ABS AC1→AC6 | — | FIG. 3 | FIG. 11 |
| 1 | ABS AC1→AC6 | ADR | FIG. 4 | FIG. 12 |
| 2 | ADR AC1→AC6 | ABS | FIG. 5 | FIG. 13 |
| 3 | ADR-ABS | AC1→AC6 | FIG. 6 | FIG. 14 |
| 4 | AC1→AC6 | ADR-ABS | FIG. 7 | FIG. 15 |
| 5 | ABS | ADR AC1→AC6 | FIG. 8 | FIG. 16 |
| 6 | ADR | ABS AC1→AC6 | FIG. 9 | FIG. 17 |
| 7 | — | ADR-ABS AC1→AC6 | FIG. 10 | FIG. 18 |

In the above table, the first column shows the various morphing degrees, the second column shows the musical tracks of the pattern A, the third column shows the musical tracks of the pattern B that are read in substitution of the homologous tracks belonging to the pattern A, while the fourth column shows the FIGS. from 3 through 10 that appear as lit graphic representations providing an immediate overview of the morphing degree obtained during the transition from the base style A into the base style B and vice versa.

Of course, other morphing degrees can be provided by combining the reading sequence of the tracks in a different manner; it is also possible for the user, by means of the buttons A and B and of proper program means, to select patterns of styles that are different from the pre-determined ones, changing the morphing degrees and types and taking his own choices.

The method for musical morphing between different styles according to the present invention can be clarified more in detail by referring to a specific example like that shown in the FIGS. from 11 through 18, that represent the various morphing degrees that are possible when transforming a base style A into a base style B.

The various figures shown the base pattern of the style A with its corresponding tracks of musical data, the base pattern of the style B with its corresponding musical tracks, as well as the new pattern of the style AB that is virtually obtained by morphing the two previous patterns. Between the two patterns of the styles A and B and the combined patterns of the style AB, there is a grill diagram indicating the various combinations that have been pre-determined by the manufacturer, wherein the black dots stand for the various logical switches under the condition in which the reading pointers are activated for each of the tracks, namely the current reading locations and addresses for each track to obtain the desired morphing degree, during the transition from the style A into the style B and vice versa.

In particular, FIG. 11 represents the morphing degree 0, in which the style AB fully corresponds with the style A; this condition is also shown by the lit graphic representation of FIG. 3.

FIG. 12 represents the morphing degree 1, in which the style AB is obtained by combining the track ADR of the style B, that replaces the homologous ADR track in the style A, with the remaining tracks in the style A (ABS, AC1 through AC2); this condition is also shown by the lit graphic representation of FIG. 4.

FIG. 13 represents the morphing degree 2, in which the ABS track in the style B is combined with the ADR and AC1~AC6 tracks in the style A, and replaces the homologous ABS track in the style B; this condition is also shown by the lit graphic representation of FIG. 5.

FIG. 14 represents the morphing degree 3 indicated in the above table, in which the tracks from AC1 to AC6 in the style B are combined or read simultaneously with the ADR and ABS tracks in the style A, thus obtaining the style AB; this condition is also shown by the lit graphic representation of FIG. 6.

As indicated in the above mentioned table, the following figures shown the remaining morphing degrees between the style A and the style B in a similar way.

According to a possible variant of the method compliant with the present invention, by means of a special control button the user can save at least one musical pattern, resulting from morphing different styles with the desired morphing degree, in the RAM memory of the apparatus so as to be able to have it immediately available to use later on.

So, according to the present invention, thanks to the replacement of homologous tracks (bass with bass, drums with drums, orchestral instruments with other similar ones, etc.) it is practically assured that a consistent, anyway creative and pleasant musical result can be obtained, even though such operation is carried out by a beginner musician. This is all the more true according to this typical application, wherein when a style A is chosen, it is automatically coupled with a style B, that is musically similar to the former, for example under the point of view of musical tempo, performing speed, style family. Furthermore, it is to clarify that if the user wishes to choose a style B other than the pre-set one, the user just has to keep the B button pressed and simultaneously press a different style within the "Pattern selection" section in the control panel.

In the previous examples of FIGS. 11 to 18, a method has been described for creating arrangements of melodic and/or rhythmic parts of musical accompaniments by musically morphing between two patterns of different styles. As previously stated the musical morphing between the patterns A and B, is obtained by conjointly reading a number of data tracks pertaining to different musical families of a first pattern (either A or B), and a number of homologous data tracks pertaining to different musical families of the other pattern (either A or B), corresponding to the remaining data tracks, of said first pattern; to this purpose, the reader of the reading block 11 should be provided with a corresponding number of pointers for reading the maximum number of tracks allowed or comprised in the base patterns stored in the apparatus.

According to the present invention morphing is also possible among more than two musical patterns having a same or different number of data tracks, by using the same morphing procedure.

More precisely, in the event that the musical morphing should be performed among three or more base patterns having a same or different number of musical tracks, according to the invention it is possible to select different data tracks from each of the patterns and conjointly reading-out or combining, in a consistent musical manner, the selected tracks of the involved patterns to create a virtual new pattern in which each data track comprises the musical data of a homologous data track of one of the base patterns, still making uniform the musical measures and temporal lengths of all selected data tracks.

What we claim is:

1. A method for creating arrangements of melodic and/or rhythmic parts of musical accompaniments by musically morphing accompaniments of different base styles, in which each accompaniment comprises a musical pattern including a plurality of data tracks relating to different families of musical instruments, comprising the steps of:

storing a number of musical patterns of different base styles that each include a plurality of the data tracks into a memory of an electronic apparatus suitable for the composition and playing of musical data, said apparatus comprising control means to select the musical patterns stored in said memory;

selecting a first musical pattern relating to a first base style from among said plurality of musical patterns stored in said memory;

selecting a second musical pattern relating to a second base style from among said plurality of stored musical patterns store in said memory; and creating a new accompaniment of an intermediate style by a musical morphing procedure comprising the additional steps of reading the data tracks of said first musical pattern, and replacing at least one entire data track of said first musical pattern with an entire homologous data track of said second musical pattern, making the musical measure number and the temporal length of the data track of said second musical pattern conform with the musical measure number and temporal length of the tracks of said first musical pattern, while keeping musically consistent conditions during the data track replacement and the performance of the new musical accompaniment.

2. A method, according to claim 1, comprising the step of storing at least one musical pattern, obtained by morphing different styles, which is stored into a reading and writing access type memory of the electronic apparatus, such pattern being stored for a subsequent use by a performer.

3. A method according to claim 1, in which each of said first and second musical patterns comprises a first track relating to a drum accompaniment (ADR), a second track relating to a bass accompaniment (ABS), and a set of tracks relating to different types of orchestral accompaniments (AC1–AC6), and in which different and progressively increasing musical morphing degrees can be chosen between the selected patterns, wherein:

a first morphing degree comprises the data track relating to the drum accompaniment of said second musical pattern replacing a corresponding data track of said first musical pattern, and the remaining data tracks of the latter;

a second morphing degree comprises the data track relating to the bass accompaniment of said second musical pattern replacing a corresponding data track of said first musical pattern, and the remaining data tracks of the latter;

a third morphing degree comprises at least part of the data tracks relating to the orchestral accompaniments of said second musical pattern replacing the corresponding data tracks of said first musical pattern, and the remaining data tracks of the latter;

a fourth morphing degree comprises the data track relating to the drum accompaniment and the data track relating to the bass accompaniment of said second musical pattern replacing the corresponding data tracks of said first musical pattern, as well as the remaining data tracks of the latter;

a fifth morphing degree comprises the data track relating to the drum accompaniment and at least part of the data tracks relating to the orchestral accompaniments of said second musical pattern replacing the corresponding data tracks of said first musical pattern, as well as the remaining data tracks of the latter;

a sixth morphing degree comprises the data track relating to the drum accompaniment and at least part of the data tracks relating to the orchestral accompaniments of said second musical pattern replacing the corresponding data tracks of said first musical pattern, as well as the remaining data tracks of the latter.

4. An electronic apparatus suitable to create arrangements of orchestral accompaniments by morphing musical patterns from a plurality of patterns of different base styles, in which each musical pattern comprises a number of tracks having musical data belonging to different instruments families, in which the musical data of the tracks comprise musical measure numbers and temporal lengths, and in which different musical morphing degrees are provided by replacing at least one entire track of a first pattern with a homologous track of a second pattern selected from said plurality of patterns of different styles, the apparatus comprising:

a programmable control unit;

memory means to store in said control unit a plurality of musical patterns relating to different accompaniment base-styles;

program means in the control unit comprising first program instructions to select first and second musical patterns from said plurality of patterns stored in said memory means, and to automatically relate said first and second musical patterns selected from said plurality, as well as second program instructions to define different musical morphing degrees between said first and second selected patterns of different styles;

first manually operable selecting means, to select patterns from said plurality of patterns of different styles;

a second manually operable selecting means to select a musical morphing degree; and program control means in the control unit to conjointly read-out the tracks of one of said musical patterns and the tracks of the other one of said musical patterns corresponding to remaining homologous data tracks of said one pattern, and replace at least an entire one of the tracks of said one pattern with an entire homologous track from said other pattern in accordance with a selected morphing degree, thus making the musical measure number and the temporal length of the tracks of said other pattern, conform with the musical measure number and the temporal length of the remaining tracks of said one pattern, while keeping musically consistent conditions during reading of the data tracks and the performance of the new musical accompaniment.

5. An apparatus according to claim 4, wherein the program means include instructions to automatically select patterns belonging to different styles musically similar to one another, in a pre-determined manner.

6. An apparatus according to claim 5, wherein the program means include instructions to select different musical pattern degrees in a pre-determined manner.

7. An apparatus according to claim 4, wherein the program means include instructions to select different patterns belonging to different styles and different morphing degrees, in a programmable manner by a user.

8. An apparatus according to claim 4, including a control panel to start various functions, said control panel comprising a first and a second control button for assigning patterns belonging to different base styles, respectively for selecting pre-determined musical morphing degrees by means said program means.

9. An apparatus according to claim 4, comprising a light graphic representation to show the selected musical morphing degree.

10. A method for creating arrangements of melodic and/or rhythmic parts of musical accompaniments by musically morphing between accompaniments of different styles, in which each accompaniment comprises a musical pattern including data tracks relating to different families of musical instruments, comprising the steps of:

storing a plurality of musical patterns of different styles that each include a plurality of the data tracks into a memory of an electronic apparatus suitable for the composition of musical data;

conjointly reading out different data tracks from at least first and second patterns of the plurality of patterns stored in said memory; and creating a new accompaniment by performing a musical morphing procedure between said first and second patterns, comprising the additional step of replacing at least one entire track of said first pattern, with an entire homologous track of said second pattern, and making the musical measure number and the temporal length of the track of the said second pattern, conform with the musical measure number and temporal length of the track of said first pattern, while keeping musically consistent conditions during track replacement and the performance of the new musical accompaniment.

* * * * *